US010933506B2

(12) United States Patent
Kerestes et al.

(10) Patent No.: US 10,933,506 B2
(45) Date of Patent: Mar. 2, 2021

(54) MONOPODIC SANDER AND METHOD FOR OPERATING THE SAME

(71) Applicant: The Boeing Company, Chicago, IL (US)

(72) Inventors: Jason A. Kerestes, Charleston, SC (US); Kadon A. Kyte, Charleston, SC (US); Colton M. Smoot, Charleston, SC (US)

(73) Assignee: The Boeing Company, Chicago, IL (US)

( * ) Notice: Subject to any disclaimer, the term of this patent is extended or adjusted under 35 U.S.C. 154(b) by 458 days.

(21) Appl. No.: 15/894,478

(22) Filed: Feb. 12, 2018

(65) Prior Publication Data

US 2019/0247972 A1 Aug. 15, 2019

(51) Int. Cl.

| | |
|---|---|
| ***B24B 55/05*** | (2006.01) |
| ***B24B 55/10*** | (2006.01) |
| ***B24B 23/02*** | (2006.01) |
| ***B24B 1/00*** | (2006.01) |
| ***B24B 7/18*** | (2006.01) |

(52) U.S. Cl.

CPC ..... *B24B 23/02* (2013.01); *B24B 1/00* (2013.01); *B24B 7/18* (2013.01); *B24B 7/184* (2013.01); *B24B 7/186* (2013.01); *B24B 23/026* (2013.01); *B24B 55/05* (2013.01); *B24B 55/10* (2013.01)

(58) Field of Classification Search

CPC ..... B24B 23/02; B24B 23/026; B24B 7/18; B24B 7/184; B24B 7/186; B24B 55/05; B24B 55/052; B24B 55/10; B24B 55/102

USPC ..... 451/344, 354, 359, 456

See application file for complete search history.

(56) References Cited

U.S. PATENT DOCUMENTS

| | | | | | |
|---|---|---|---|---|---|
| 4,204,292 | A * | 5/1980 | Lester | A46B 5/005 | 15/144.4 |
| 4,399,578 | A * | 8/1983 | Bordeaux | A47L 11/12 | 15/230 |
| 4,829,719 | A * | 5/1989 | Braselton | B24B 23/04 | 15/144.2 |
| 4,870,730 | A * | 10/1989 | Belknap | B24B 7/184 | 29/26 A |
| 5,289,605 | A * | 3/1994 | Armbruster | A47L 11/282 | 15/144.4 |
| 6,722,967 | B1 * | 4/2004 | Oddo | B23Q 9/00 | 451/353 |
| 6,793,567 | B1 * | 9/2004 | Corkill | A47L 11/162 | 451/350 |
| 7,074,111 | B2 * | 7/2006 | Cecil | B24B 7/182 | 451/24 |
| 7,249,996 | B1 * | 7/2007 | Volyar | B24B 7/184 | 451/354 |

(Continued)

OTHER PUBLICATIONS https://www.ergonomicpartners.com/zero-gravity-tool-balancer.aspx.

*Primary Examiner* — Eileen P Morgan

(74) *Attorney, Agent, or Firm* — Walters & Wasylyna LLC

(57) ABSTRACT

A monopodic sander is provided for an operator to sand a surface. The monopodic sander comprises a rotary sanding head for contacting the surface and an extendable actuator rod having one end pivotally coupled to the rotary sanding head. The monopodic sander further comprises a controller handle operatively coupled to the one end of the extendable actuator rod to allow the operator to select a pressure applied by the rotary sanding head against the surface.

20 Claims, 8 Drawing Sheets

(56) References Cited

U.S. PATENT DOCUMENTS

| | | | | |
|---|---|---|---|---|
| 7,549,913 | B2 * | 6/2009 | Weiford | B24B 7/184 451/354 |
| 7,828,631 | B1 * | 11/2010 | Herbert | B24B 7/18 451/344 |
| 8,844,884 | B2 * | 9/2014 | Bottazzi | B24B 55/10 248/122.1 |
| 9,242,365 | B1 * | 1/2016 | Bureau | B25G 1/04 |
| 9,364,935 | B2 | 6/2016 | Fuller | |
| 9,534,730 | B2 | 1/2017 | Black et al. | |
| 2002/0132570 | A1 * | 9/2002 | Berg | B24B 23/005 451/344 |
| 2004/0072519 | A1 * | 4/2004 | Oddo | B23Q 11/0046 451/353 |
| 2008/0201877 | A1 * | 8/2008 | Sengewald | A47L 11/4075 15/4 |
| 2010/0048108 | A1 * | 2/2010 | Stott | B24B 23/005 451/344 |
| 2013/0074966 | A1 * | 3/2013 | Bottazzi | B24B 7/184 137/899 |
| 2016/0016300 | A1 * | 1/2016 | Bureau | B25G 1/04 451/162 |
| 2016/0184954 | A1 * | 6/2016 | Roeck | B24B 7/186 451/344 |
| 2017/0307132 | A1 | 10/2017 | Kerestes | |
| 2019/0160622 | A1 * | 5/2019 | Barth | B24B 47/12 |

* cited by examiner

MONOPODIC SANDER AND METHOD FOR OPERATING THE SAME

FIELD

The present application relates to sanders and, more particularly, to monopodic sanders and methods for controlling the same.

BACKGROUND

A known application of a sander is sanding an underwing structure of an aircraft. Underwing sanding poses a number of ergonomic challenges for a person operating a sander. Accordingly, those skilled in the art continue with research and development efforts in the field of sanders for various applications such as sanding an underwing structure of an aircraft.

SUMMARY

In one aspect, a monopodic sander is provided for an operator to sand a surface, such as an overhead surface. The monopodic sander comprises a rotary sanding head for contacting the surface and an extendable actuator rod having one end pivotally coupled to the rotary sanding head. The monopodic sander further comprises a controller handle operatively coupled to the one end of the extendable actuator rod to allow the operator to select a pressure applied by the rotary sanding head against the surface.

In another aspect, a monopodic sander is provided for an operator to sand a surface, such as an overhead surface. The monopodic sander comprises a rotary sanding head for contacting the surface and an extendable actuator rod having one end pivotally coupled to the rotary sanding head. The monopodic sander further comprises a dust containment shield surrounding the rotary sanding head and configured to create a suction effect around the rotary sanding head to collect dust particles as the rotary sanding head is moving laterally across the surface and pivoting about the one end of the extendable actuator rod during operation of the monopodic sander.

In yet another aspect, a method for operating a monopodic sander is provided. The method comprises contacting a rotary sanding head of the monopodic sander against a surface, such as an overhead surface, with a substantially constant predetermined pressure. The method further comprises maintaining the rotary sanding head against the surface with the substantially constant predetermined pressure as the rotary sanding head moves laterally across the surface during operation of the monopodic sander.

In still another aspect, a method for operating a monopodic sander is provided. The method comprises contacting a rotary sanding head of the monopodic sander against a surface, such as an overhead surface. The method further comprises creating a suction effect around the rotary sanding head to collect dust particles as the rotary sanding head is moving laterally across the surface during operation of the monopodic sander.

Other aspects will become apparent from the following detailed description, the accompanying drawings and the appended claims.

DETAILED DESCRIPTION

The present application is directed to monopodic sanders and methods of controlling the same for an aerospace vehicle such as an aircraft. Non-aerospace applications are also contemplated. The specific monopodic sander and method, and the industry in which the monopodic sander and method are implemented may vary. It is to be understood that the disclosure below provides a number of embodiments or examples for implementing different features of various embodiments. Specific examples of components and arrangements are described to simplify the present disclosure. These are merely examples and are not intended to be limiting.

By way of example, the disclosure below describes monopodic sanders and methods of controlling the same for airplanes. More specifically, the disclosure below describes a monopodic sander for sanding an underwing structure of an airplane. The monopodic sander and method for operating the monopodic sander may be implemented by an original equipment manufacturer (OEM) for assembling airplane structures in compliance with military and space regulations.

Figure 1:
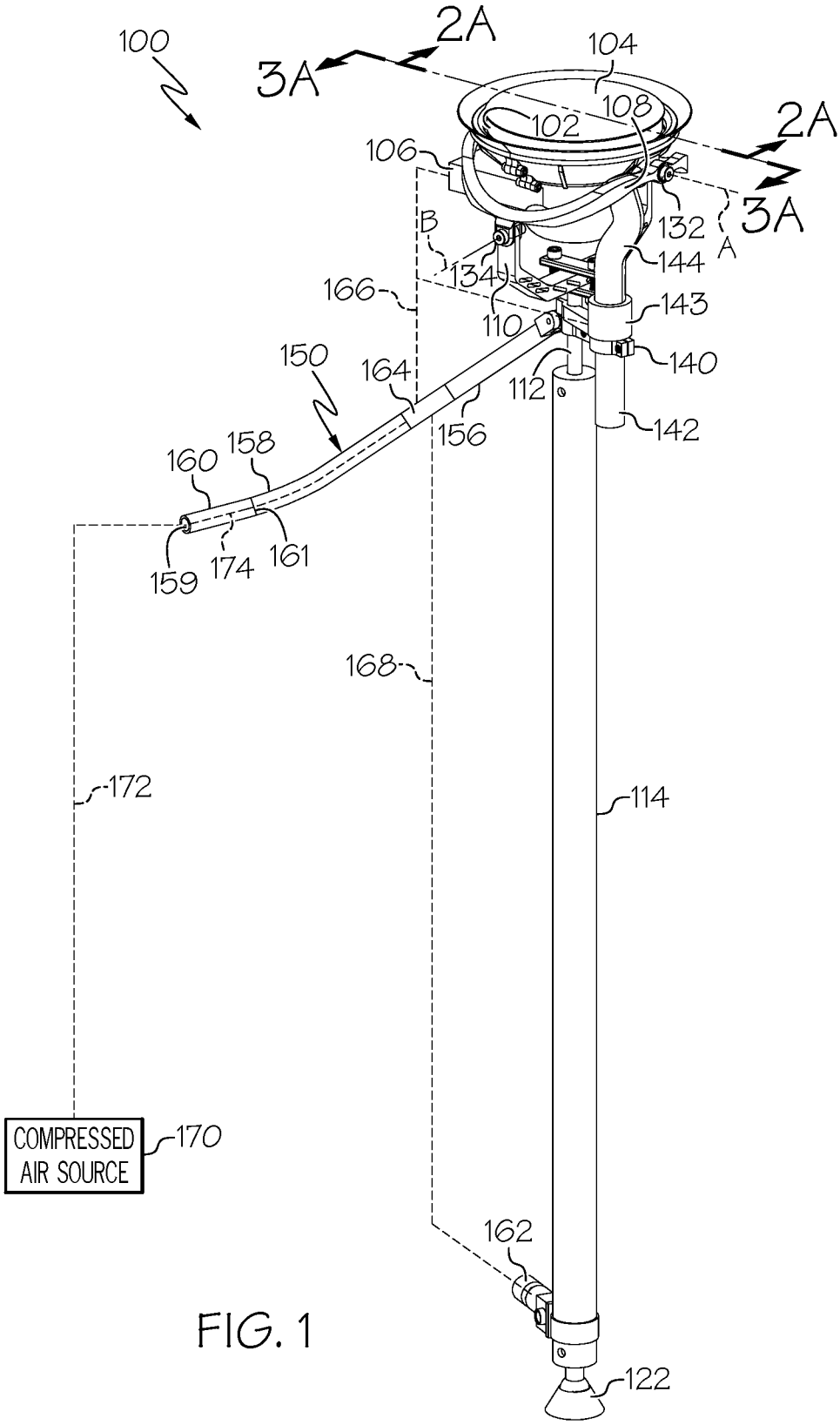
FIG. 1 is a perspective view of an example monopodic sander constructed in accordance with an embodiment.
Figure 2A:
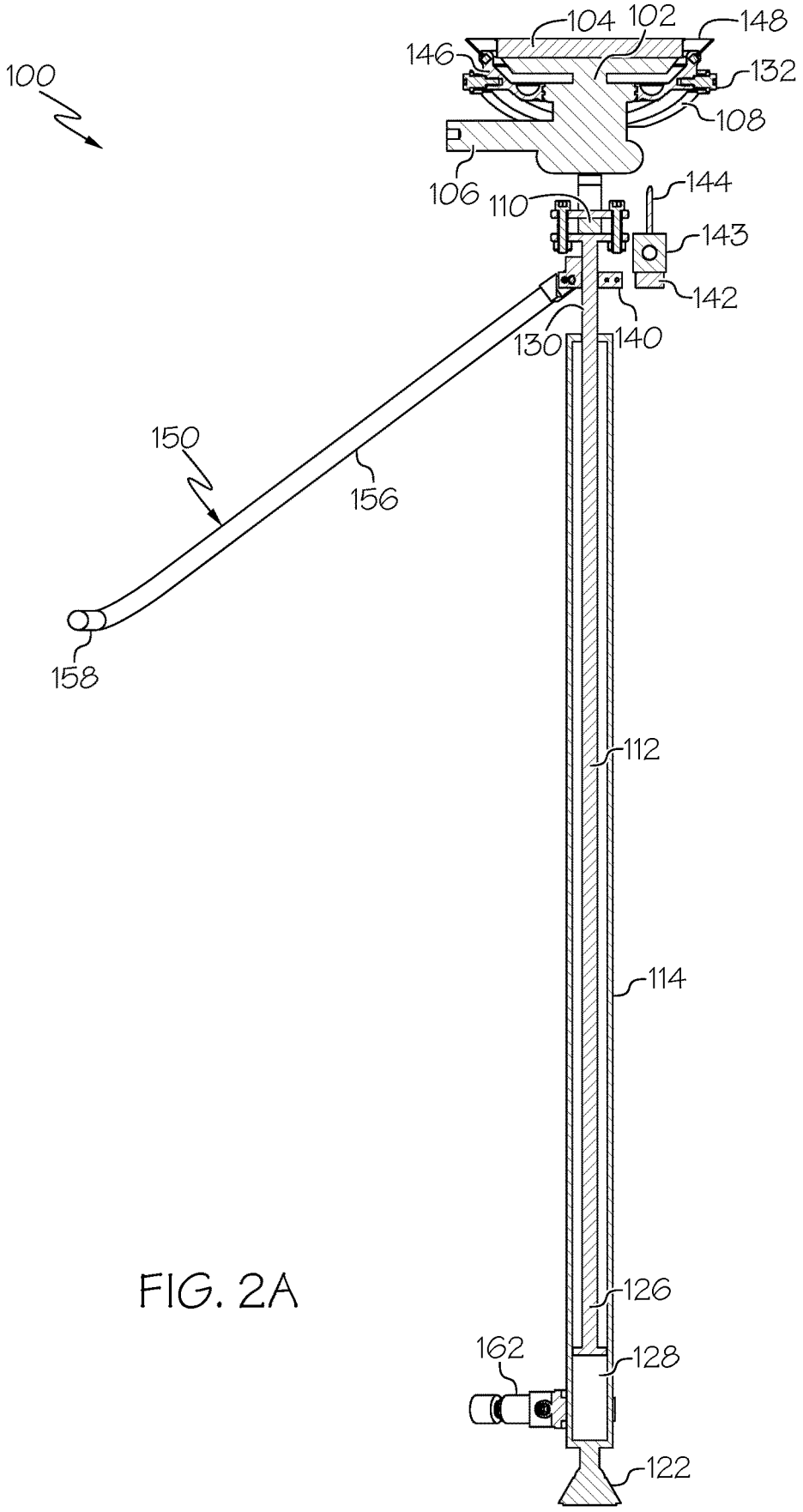
FIG. 2A is a sectional view, taken approximately along line 2A-2A shown in FIG. 1, of certain parts of the monopodic sander.
Figure 2B:
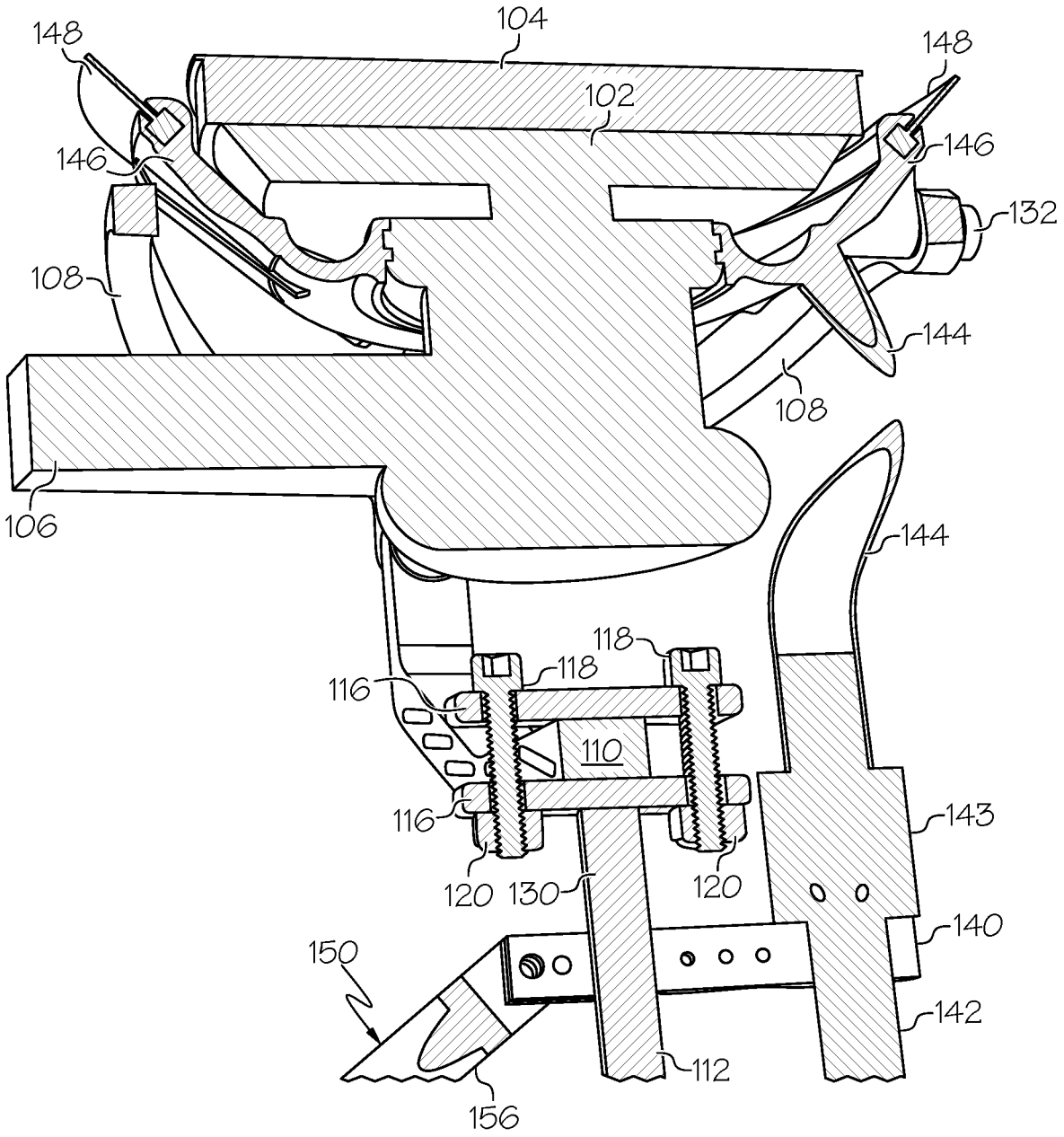
FIG. 2B an enlarged view of a portion of FIG. 2A.
Figure 3A:
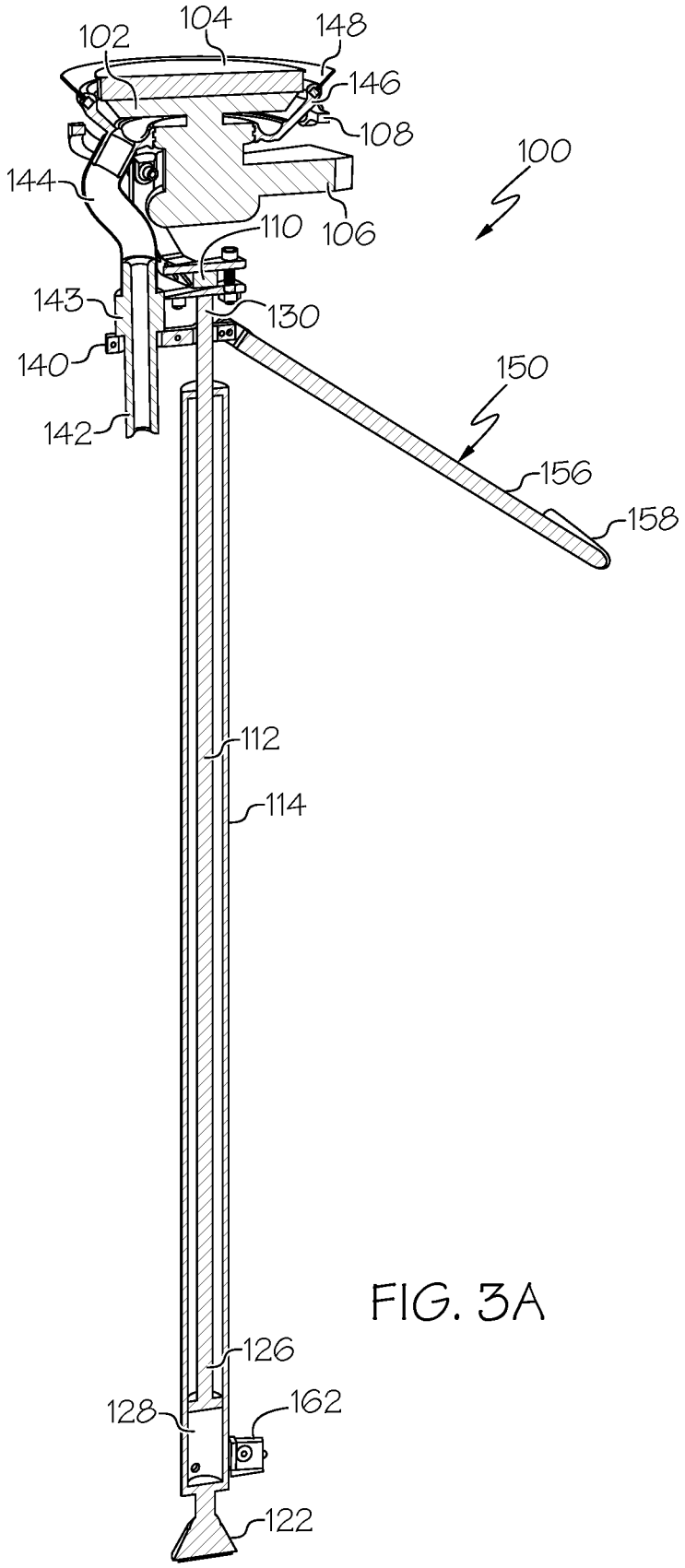
FIG. 3A is a sectional view, taken approximately along line 3A-3A shown in FIG. 1, of certain parts of the monopodic sander.
Figure 3B:
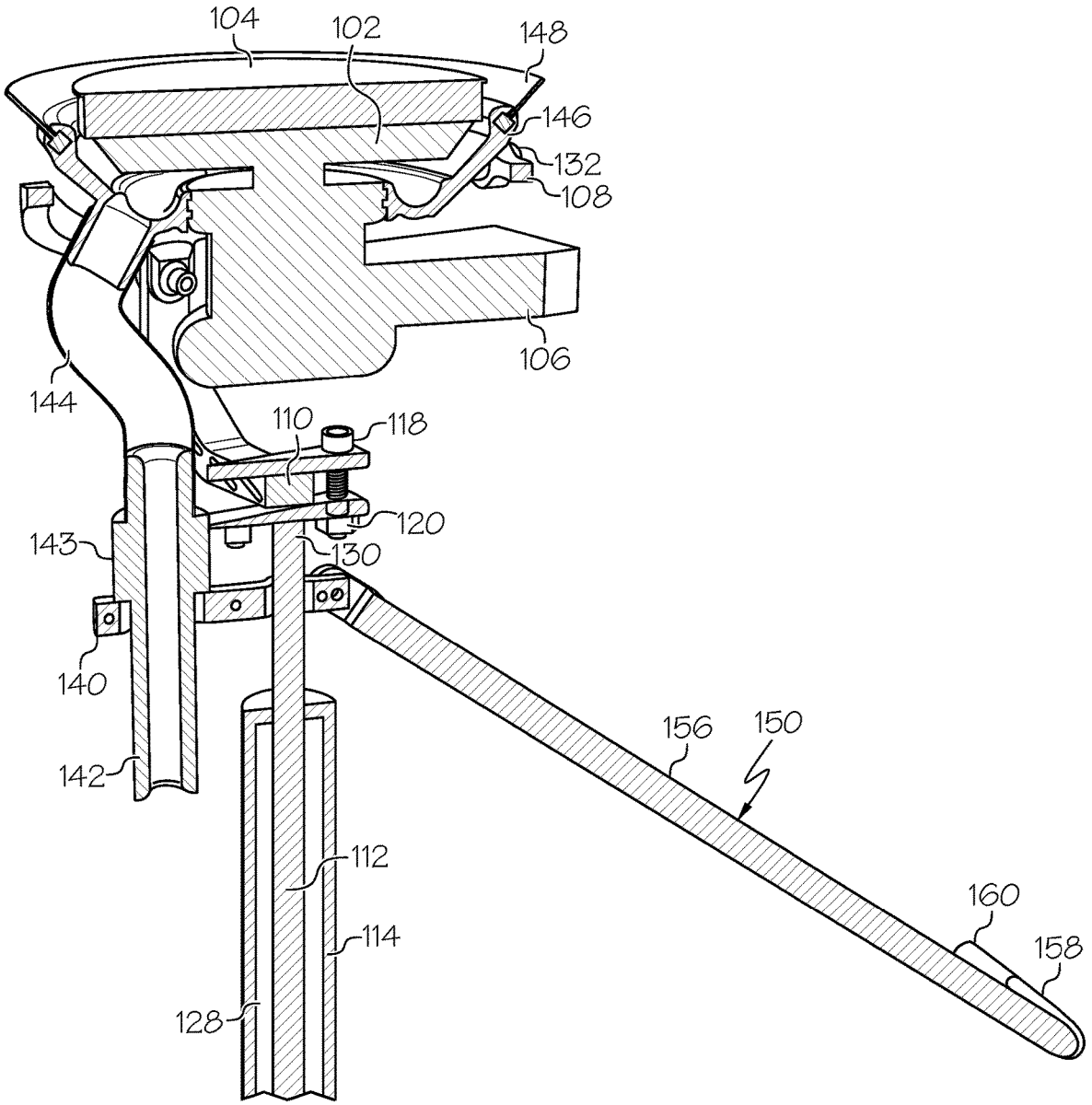
FIG. 3B an enlarged view of a portion of FIG. 3A.

Referring to FIG. 1, a perspective view of an example monopodic sander 100 constructed in accordance with an embodiment is illustrated. FIG. 2A shows a sectional view, taken approximately along line 2A-2A shown in FIG. 1, of certain parts of the monopodic sander 100. More specifically, some pneumatic components are omitted in FIG. 2A. FIG. 2B shows an enlarged view of a portion of FIG. 2A. FIG. 3A shows a sectional view, taken approximately along line 3A-3A shown in FIG. 1, of certain parts of the monopodic sander 100. More specifically, some pneumatic components are omitted in FIG. 3A. FIG. 3B shows an enlarged view of a portion of FIG. 3A.

The monopodic sander 100 includes a rotary sanding head 102 for contacting a surface (not shown), such as an overhead surface (e.g., an underwing structure of an airplane). A sanding pad 104 is disposed on the rotary sanding head 102 for contacting a surface to be sanded. A pneumatic motor 106 is operatively coupled to the rotary sanding head 102 in known manner to drive the rotary sanding head 102 to move the sanding pad 104 laterally across the surface to be sanded. Structure and operation of rotary sanding heads and pneumatic motors for driving rotary sanding heads are known and conventional and, therefore, will not be described.

The monopodic sander 100 further includes a gimbal ring 108 that is operatively coupled to an attachment arm 110. The attachment arm 110 is connected to an extendable actuator rod 112 of a counter-balance actuator 114 by using a pair of clamp bars 116 that are fastened together with a pair of bolts 118 and a mating pair of nuts 120. A foot 122 is attached to an end of the actuator 114 to support the monopodic sander 100 on a floor (not shown). The actuator rod 112 is shown in the figures as near fully retracted.

A first end 126 of the extendable actuator rod 112 telescopes in an air chamber 128 of the actuator 114. A second end 130 of the extendable actuator rod 112 is connected through the gimbal mechanism (i.e., the attachment arm 110 and the gimbal ring 108) to the rotary sanding head 102. The gimbal mechanism supports the rotary sanding head 102 for rotation about a first axis "A" (FIG. 1) using a pair of shoulder bolts 132 and a second axis "B" that is transverse to the first axis A using another pair of shoulder bolts 134. Thus, the second end 130 of the extendable actuator rod 112 is pivotally coupled to the rotary sanding head 102. Structure and operation of gimbal mechanisms are known and conventional and, therefore, will not be described.

The monopodic sander 100 also includes an accessory attachment clamp 140 to which a dust collection device 142 and a vacuum device 143 are attached on one side of the clamp 140. A dust collection tube 144 interconnects the vacuum device 143 and a substantially circular-shaped motor shroud 146 that surrounds the pneumatic motor 106 and the rotary sanding head 102. A substantially circular-shaped dust containment shield 148 is concentric with the motor shroud 146, and surrounds the sanding pad 104. The circular-shaped dust containment shield 148 has a diameter that is greater than the diameter of the sanding pad 104. The dust containment shield 148 is configured to create a suction effect around the rotary sanding head 102 to collect dust particles as the rotary sanding head 102 is moving laterally across the surface and pivoting about the second end 130 of the extendable actuator rod 112 during operation of the monopodic sander 100.

A controller handle 150 is attached on an opposite side of the accessory attachment clamp 140. The controller handle 150 is operatively connected via the clamp 140 to the second end 130 of the extendable actuator rod 112. The controller handle 150 allows an operator to select a pressure applied by the rotary sanding head 102 against the surface to sand the surface, as will be described herein.

In the example embodiment shown in FIG. 1, the controller handle 150 comprises a substantially L-shaped arm. The L-shaped arm of the controller handle 150 includes a first arm portion 156 and a second arm portion 158. The first arm portion 156 is pivotally coupled through the accessory attachment clamp 140 to the second end 130 of the extendable actuator rod 112 to allow the operator to use one hand to adjust height of the rotary sanding head 102. In some embodiments, the first arm portion 156 is pivotally coupled to the second end of the extendable actuator rod 112 using a ball joint that can pivot at an angle up to about 30 degrees.

The controller handle 150 includes a hand-operated actuator 160 for allowing the operator to adjust a flow rate of pressurized air to the rotary sanding head 102 and thereby to allow the operator to select the pressure applied by the rotary sanding head 102 against the surface. The hand-operated actuator 160 comprises a pneumatic valve that is slidable between a fully closed position and a fully open position. The pneumatic valve of the hand-operated actuator 160 is positioned on the second arm portion 158 so as to allow the operator to use the other hand to slide the pneumatic valve of the hand-operated actuator 160 between the fully closed position and the fully open position to adjust the pressure applied by the rotary sanding head 102 against the surface. Thus, the rotary sanding head 102 moves towards the surface in response to the operator sliding the pneumatic valve of the hand-operated actuator 160 in a first direction, and moves away from the surface in response to the operator sliding the pneumatic valve of the hand-operated actuator 160 in a second direction which is opposite the first direction. The hand-operated actuator 160 may comprise a lever that is pressed or moved to cause the pneumatic valve to deliver pressurized air to the rotary sanding head 102 for operating the sanding head, and is movable to a fully closed position upon release by the operator's hand to cause the pneumatic valve to close and discontinue delivery of pressurized air, to provide a safety function for turning off the sander.

The monopodic sander 100 further comprises a pressure regulator 162 for maintaining the selected pressure that is applied by the rotary sanding head 102 against the surface substantially constant as the rotary sanding head 102 is moving laterally across the surface and pivoting about the second end 130 of the extendable actuator rod 112 during operation of the monopodic sander 100. The pressure regulator 162 regulates pressure in the air chamber 128 of the actuator 114 by equalizing pressure in the air chamber 128 when the rotary sanding head 102 is contacting the surface during operation of the monopodic sander 100. An example pressure regulator that can be used is model number 41595K21 commercially available from McMaster-Carr of Elmhurst, Ill. Other pressure regulators from other sources are possible.

A compressed air source 170 (FIG. 1) provides pressurized air in pneumatic line 172 to air inlet 159 of the pneumatic valve of the hand-operated actuator 160. The amount of pressurized air that passes through the pneumatic valve of the hand-operated actuator 160 along pneumatic line 174 to air outlet 161 depends upon the position of the pneumatic valve of the hand-operated actuator 160 as selected by the operator.

The monopodic sander 100 also comprises an air splitter 164 (shown only in FIG. 1) that is disposed on a portion of the controller handle 150. The air splitter 164 splits pressurized air from the air outlet 161 of the pneumatic valve of the hand-operated actuator 160 into a first air path in pneumatic line 166 and a second air path in pneumatic line 168. The first air path in pneumatic line 166 is in fluid communication with the rotary sanding head 102 to power the rotary sanding head 102. The first air path in pneumatic line 166 is also in fluid communication with the vacuum device 143 to create a vacuum. More specifically, the vacuum created by the vacuum device 143 provides a suction effect between the dust containment shield 148 and the rotary sanding head 102 to collect dust particles as the rotary sanding head 102 is moving laterally across the surface and pivoting about the second end 130 of the extendable actuator rod 112 during operation of the monopodic sander 100.

The second air path in pneumatic line 168 is in fluid communication with the pressure regulator 162. As previously mentioned, the pressure regulator 162 regulates pressure in the air chamber 128 of the actuator 114 by equalizing pressure in the air chamber 128 when the rotary sanding head 102 is contacting the surface (or when the extendable actuator rod 112 has reached its maximum length of extension) during operation of the monopodic sander 100.

Figure 4:
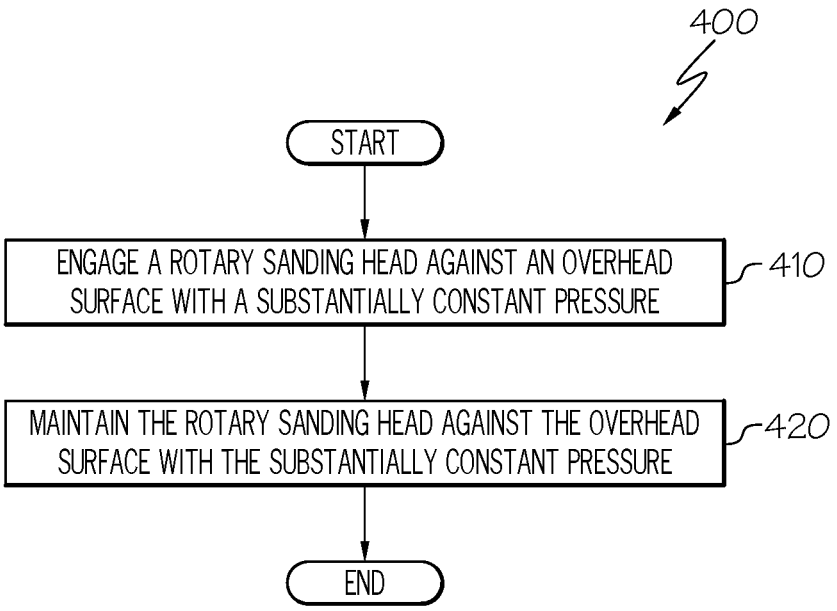
FIG. 4 is a flow diagram depicting an example method for operating the monopodic sander of FIG. 1 in accordance with an embodiment.

FIG. 4 is a flow diagram depicting an example method for operating the monopodic sander of FIG. 1 in accordance with an embodiment. In block 410, a rotary sanding head of the monopodic sander is contacted against a surface with a substantially constant predetermined pressure. The process proceeds to block 420.

In block 420, the rotary sanding head is maintained against the surface with the substantially constant predetermined pressure as the rotary sanding head moves laterally across the surface during operation of the monopodic sander. The process then ends.

In some embodiments, the rotary sanding head is contacted against the surface with a pressure selected by an operator of the monopodic sander.

In some embodiments, the rotary sanding head is contacted against the surface with the selected pressure in response to the operator sliding a pneumatic valve in a first direction. In some embodiments, the rotary sanding head is moved away from the surface in response to the operator sliding the pneumatic valve in a second direction which is opposite the first direction.

In some embodiments, the rotary sanding head is contacted against the surface with a selected pressure sufficient to remove material from the surface.

Figure 5:
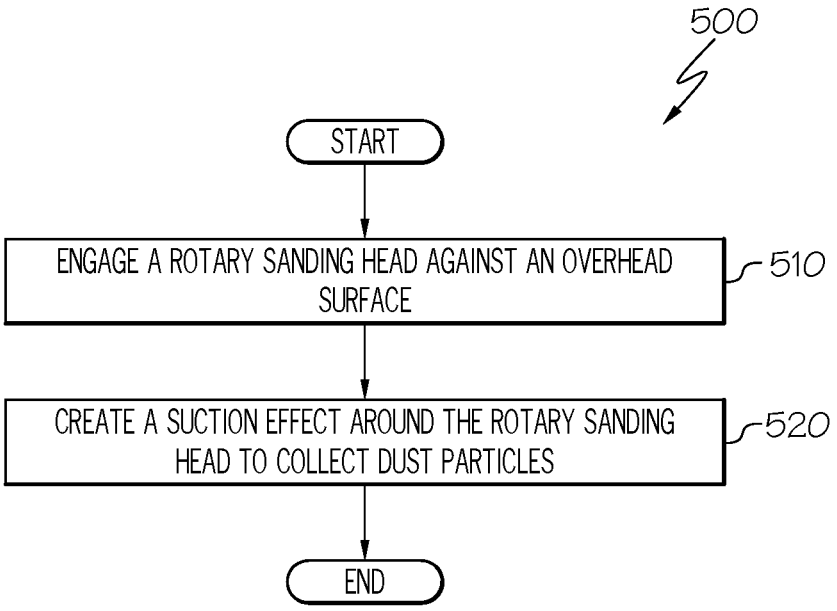
FIG. 5 is a flow diagram depicting an example method for operating the monopodic sander of FIG. 1 in accordance with another embodiment.

FIG. 5 is a flow diagram depicting an example method for operating the monopodic sander of FIG. 1 in accordance with another embodiment. In block 510, a rotary sanding head of the monopodic sander is contacted against a surface. The process proceeds to block 520.

In block 520, a suction effect around the rotary sanding head is created to collect dust particles as the rotary sanding head is moving laterally across the surface during operation of the monopodic sander. The process then ends.

It should be apparent that an underwing structure of an airplane that is sanded in accordance with the above-described example methods require less time and less labor to achieve. The result is a much quicker turnaround time of the sanding process as compared to known sanding methods that require more time and more labor to achieve.

Figure 3C:
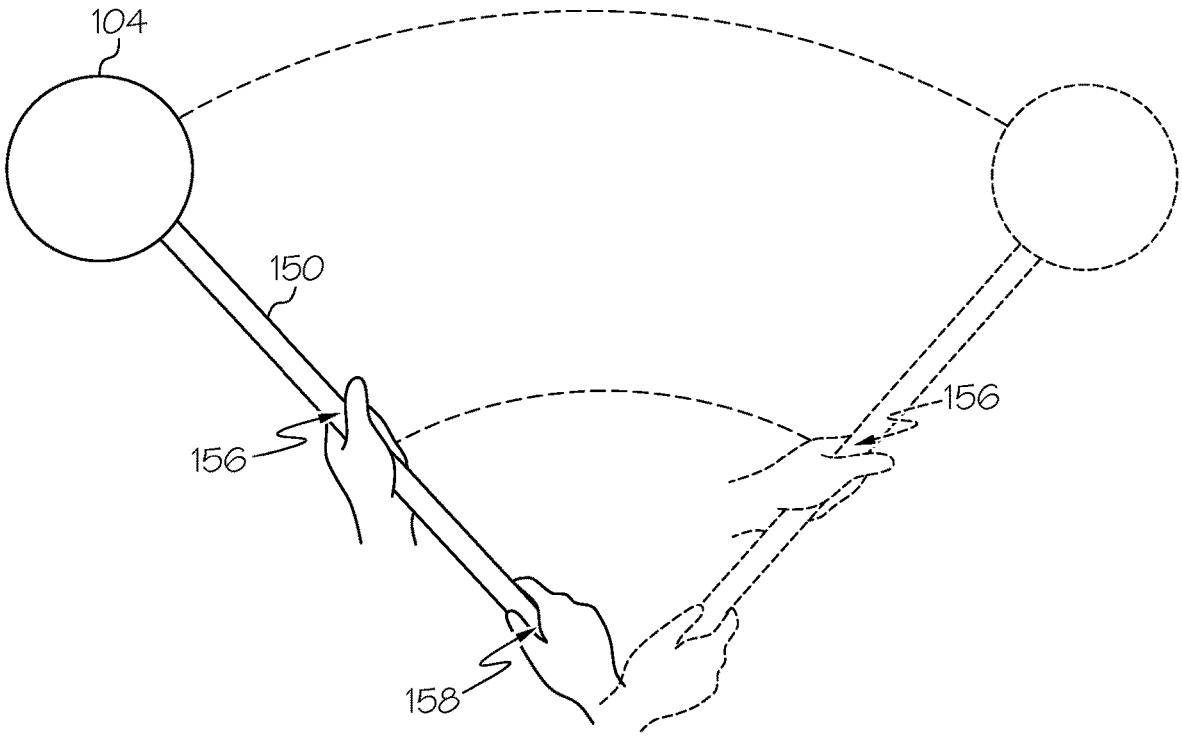
FIG. 3C depicts the monopodic sander being used by an operator.

It should also be apparent that the L-shaped arm of the controller handle 150 of the above-described monopodic sander 100 provides a mechanical advantage that reduces ergonomic risks for a person operating the monopodic sander 100. This is because the person uses one hand to control the first arm portion 156 of the L-shaped arm of the controller handle 150 to raise and lower the rotary sanding head 102, the other hand to control the second arm portion 158 of the L-shaped arm of the controller handle 150 to select the pressure applied by the rotary sanding head 102 against the surface, and both hands to move the rotary sanding head 102 laterally across the surface. The person does not need to look up to move the rotary sanding head 102 either horizontally or vertically, or both, and to select the amount of pressure applied by the rotary sanding head 102 against the surface. Moreover, the dimension ranges of the first and second arm portions 156, 158 of the L-shaped arm of the controller handle 150 allows an average-height person to easily raise and lower the rotary sanding head 102. The dimension ranges of the first and second arm portions 156, 158 are preferably sized to yield a minimum length of the controller handle 150 of about 18 inches, which allows an average-height person to easily move the rotary sanding head 102 several feet laterally across the surface, by holding the second arm portion 158 steady and swinging the first arm portion 156 with minimal back and forth movement of the controller handle, as shown in FIG. 3C. By holding the controller handle 150 at the first arm portion 156 that is about half the distance between the second arm portion 158 and the rotary sanding head 102, minimal back and forth movement at the first arm portion 156 results in a greater lateral movement distance (shown in FIG. 3C) that the rotary sanding head 102 moves laterally across the surface. In an exemplary embodiment, the dimension ranges of the first and second arm portions 156, 158 are preferably sized to yield a length of the controller handle 150 that is between 18 inches and 42 inches, and more preferably between 24 inches and 36 inches.

It should further be apparent that an integrated vacuum system (i.e., the dust collection device 142, the vacuum device 143, the dust collection tube 144, and the dust containment shield 148) is provided for collecting dust particles in the air. Accordingly, the exposure of the operator to dust particles as a result of the sanding operation is reduced.

It should also be apparent that the above-described monopodic sander 100 occupies a relatively small footprint since it stands on the floor with only the one foot 122 (i.e., a single pod) when the monopodic sander 100 is in operation.

Figure 6:
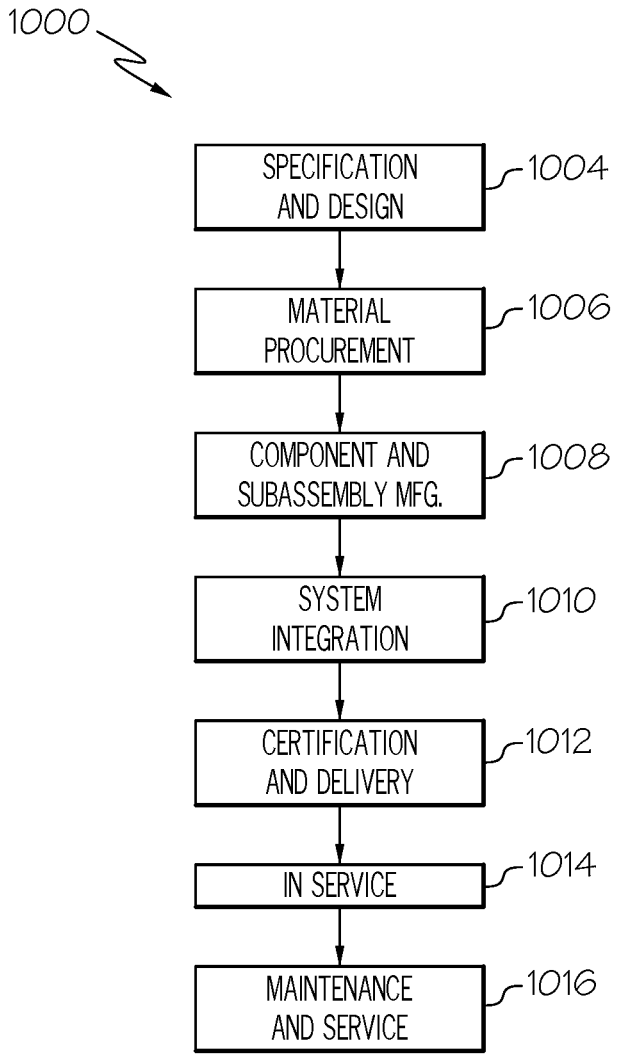
FIG. 6 is a flow diagram of an aircraft manufacturing and service methodology.
Figure 7:
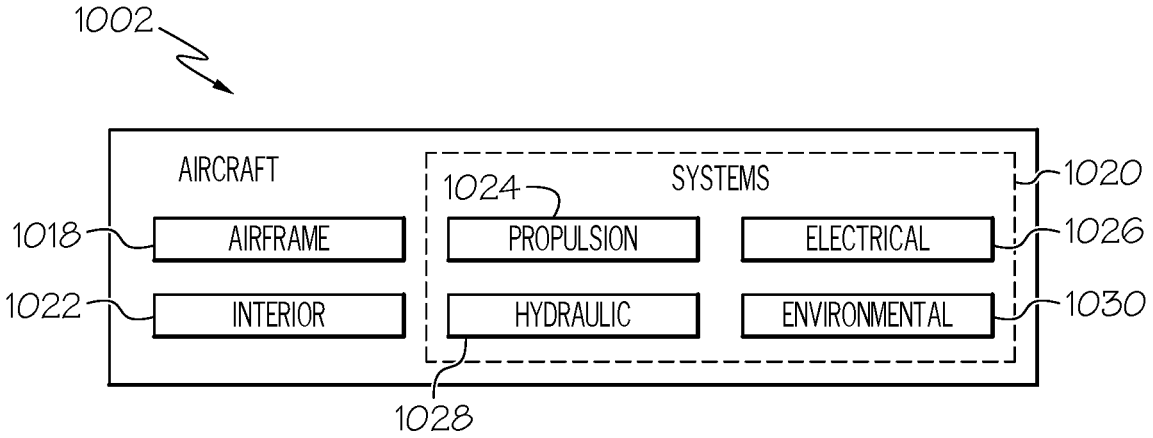
FIG. 7 is a block diagram of an aircraft.

Examples of the disclosure may be described in the context of an aircraft manufacturing and service method 1000, as shown in FIG. 6, and an aircraft 1002, as shown in FIG. 7. During pre-production, the aircraft manufacturing and service method 1000 may include specification and design 1004 of the aircraft 1002 and material procurement 1006. During production, component/subassembly manufacturing 1008 and system integration 1010 of the aircraft 1002 takes place. Thereafter, the aircraft 1002 may go through certification and delivery 1012 in order to be placed in service 1014. While in service by a customer, the aircraft 1002 is scheduled for routine maintenance and service 1016, which may also include modification, reconfiguration, refurbishment and the like.

Each of the processes of method 1000 may be performed or carried out by a system integrator, a third party, and/or an operator (e.g., a customer). For the purposes of this description, a system integrator may include without limitation any number of aircraft manufacturers and major-system subcontractors; a third party may include without limitation any number of venders, subcontractors, and suppliers; and an operator may be an airline, leasing company, military entity, service organization, and so on.

As shown in FIG. 7, the aircraft 1002 produced by example method 1000 may include an airframe 1018 with a plurality of systems 1020 and an interior 1022. Examples of the plurality of systems 1020 may include one or more of a propulsion system 1024, an electrical system 1026, a hydraulic system 1028, and an environmental system 1030. Any number of other systems may be included.

The disclosed monopodic sander and sanding methods may be employed during any one or more of the stages of the aircraft manufacturing and service method 1000. As one example, components or subassemblies corresponding to component/subassembly manufacturing 1008, system integration 1010, and/or maintenance and service 1016 may be assembled using the disclosed monopodic sanders and sanding methods. As another example, the airframe 1018 may be constructed using the disclosed monopodic sanders and sanding methods. Also, one or more apparatus examples, method examples, or a combination thereof may be utilized during component/subassembly manufacturing 1008 and/or system integration 1010, for example, by substantially expediting assembly of or reducing the cost of an aircraft 1002, such as the airframe 1018 and/or the interior 1022. Similarly, one or more of system examples, method examples, or a combination thereof may be utilized while the aircraft 1002 is in service, for example and without limitation, to maintenance and service 1016.

The above-described monopodic sanders and sanding methods are described in the context of an aircraft. However, one of ordinary skill in the art will readily recognize that the disclosed monopodic sanders and sanding methods are suitable for a variety of applications, and the present disclosure is not limited to aircraft manufacturing applications. For example, the disclosed monopodic sanders and sanding methods may be implemented in various types of vehicles including, for example, helicopters, passenger ships, automobiles, marine products (boat, motors, etc.) and the like. Non-vehicle applications are also contemplated.

Although the above description describes a pneumatic-based monopodic sander to sand underwing structures of an aircraft, it is conceivable that a monopodic sander that is other than pneumatic-based may be used.

Also, although the above-description describes monopodic sanders and sanding methods for sanding underwing structures of an airplane in the aviation industry in accordance with military and space regulations, it is contemplated that the monopodic sanders and sanding methods may be implemented to facilitate sanding for any type of large manufacturing assembly in any industry in accordance with the applicable industry standards. The specific monopodic sander and sanding method can be selected and tailored depending upon the particular application.

Further, although various aspects of disclosed embodiments have been shown and described, modifications may occur to those skilled in the art upon reading the specification. The present application includes such modifications and is limited only by the scope of the claims.

What is claimed is:

1. A monopodic sander for an operator to sand a surface, the monopodic sander comprising:

a rotary sanding head for contacting the surface;

an extendable actuator comprising an actuator rod having one end pivotally coupled to the rotary sanding head; and a controller handle comprising a first arm portion pivotally coupled to the one end of the actuator rod and a second arm portion extending from the first arm portion; and a hand-operated actuator located on the second arm portion and operably coupled to the extendable actuator, wherein:

the hand-operated actuator is operable to enable the operator to extend the actuator rod and to select a pressure applied by the rotary sanding head against the surface; and the controller handle enables the operator to use the first arm portion to move the rotary sanding head across the surface using one hand and to use the second arm portion to control the hand-operated actuator using the other hand.

2. The monopodic sander of claim 1 wherein:

the extendable actuator is pneumatically operated; and the hand-operated actuator is configured to adjust a flow rate of pressurized air to the extendable actuator and thereby enable the operator to select the pressure applied by the rotary sanding head against the surface.

3. The monopodic sander of claim 2 wherein the hand-operated actuator comprises a pneumatic valve that is slidable between at least a fully closed position and a fully open position.

4. The monopodic sander of claim 1 wherein the second arm portion is approximately perpendicular to the first arm portion so that the controller handle is substantially L-shaped.

5. The monopodic sander of claim 3 wherein the pneumatic valve is positioned on the second arm portion to enable the operator to use the other hand to slide the pneumatic valve between the fully closed position and the fully open position and thereby to adjust height of the rotary sanding head and to adjust the pressure applied by the rotary sanding head against the surface.

6. The monopodic sander of claim 1 wherein the first arm portion is pivotally coupled to the one end of the extendable actuator rod using a ball joint that can pivot at an angle up to about 30 degrees.

7. The monopodic sander of claim 3 further comprising:

a pressure regulator between the pneumatic valve and the extendable actuator for maintaining substantially constant the pressure applied by the rotary sanding head against the surface as the rotary sanding head is moving laterally across the surface and pivoting about the one end of the extendable actuator rod during operation of the monopodic sander.

8. The monopodic sander of claim 7 further comprising:

a vacuum device for providing a suction effect around the rotary sanding head to collect dust particles as the rotary sanding head is moving laterally across the surface and pivoting about the one end of the extendable actuator rod during operation of the monopodic sander.

9. The monopodic sander of claim 8 further comprising:

an air splitter for directing the pressurized air along a first air path from the pneumatic valve to the pressure regulator and along a second air path from the pneumatic valve to the vacuum device.

10. The monopodic sander of claim 1 further comprising:

a pressure regulator coupled to the extendable actuator for maintaining substantially constant the pressure applied by the rotary sanding head against the surface as the rotary sanding head is moving laterally across the surface and pivoting about the one end of the extendable actuator rod during operation of the monopodic sander.

11. The monopodic sander of claim 8 further comprising:

a dust containment shield surrounding the rotary sanding head, wherein the vacuum device is configured to create the suction effect between the rotary sanding head and the dust containment shield.

12. A method for operating a monopodic sander of claim 1, the method comprising:

contacting a rotary sanding head of the monopodic sander against a surface with a substantially constant predetermined pressure; and maintaining the rotary sanding head against the surface with the substantially constant predetermined pressure as the rotary sanding head moves laterally across the surface during operation of the monopodic sander.

13. The method of claim 12 wherein contacting a rotary sanding head of the monopodic sander against the surface with a substantially constant predetermined pressure comprises:

contacting the rotary sanding head against the surface with a pressure selected by an operator of the monopodic sander.

14. The method of claim 12 further comprising:

creating a suction effect around the rotary sanding head to collect dust particles as the rotary sanding head is moving laterally across the surface during operation of the monopodic sander.

15. The monopodic sander of claim 3 wherein the pneumatic valve is operably coupled to the rotary sanding head and is configured to deliver the pressurized air to the rotary sanding head for operating the rotary sanding head, and is movable to a fully closed position upon release by the operator's hand to cause the pneumatic valve to close and discontinue delivery of the pressurized air, to provide a safety function for turning off the sander.

16. The monopodic sander of claim 3 wherein the controller handle enables the operator to control the pneumatic valve to extend the rotary sanding head against the surface to be sanded, where the rotary sanding head moves towards the surface in response to the operator sliding the pneumatic valve of the hand-operated actuator in a first direction, and moves away from the surface in response to the operator sliding the pneumatic valve of the hand-operated actuator in a second direction which is opposite the first direction.

17. The monopodic sander of claim 7 wherein the pressure regulator regulates pressure in an air chamber of the extendable actuator by equalizing pressure in the air chamber when the rotary sanding head is contacting the surface during operation of the monopodic sander.

18. The monopodic sander of claim 1 further comprising a foot that is attached to an end of the extendable actuator to support the monopodic sander on a floor.

19. The monopodic sander of claim 1 wherein the actuator rod is connected through a gimbal mechanism to the rotary sanding head, where the gimbal mechanism supports the rotary sanding head for rotation about a first axis.

20. The monopodic sander of claim 2 further comprising:

an air splitter coupled to the hand-operated actuator for directing the pressurized air along a first air path from the hand-operated actuator to the extendable actuator and along a second air path from the hand-operated actuator to the rotary sanding head, wherein the hand-operated actuator is further operable to enable the operator to operate the rotary sanding head.

* * * * *